United States Patent [19]

Tanabe et al.

[11] Patent Number: 4,932,567

[45] Date of Patent: Jun. 12, 1990

[54] CONTAINER FOR FOAMY LIQUID DISCHARGED IN SMALL AMOUNTS

[75] Inventors: Yoshikazu Tanabe, Asahi; Takao Endo, Youkaichiba, both of Japan

[73] Assignee: Koatsukako Co., Ltd., Setagaya, Japan

[21] Appl. No.: 312,621

[22] Filed: Feb. 17, 1989

[30] Foreign Application Priority Data

Oct. 31, 1986 [JP] Japan ..... 61-166634

[51] Int. Cl.[5] ..... B05B 7/24

[52] U.S. Cl. ..... 222/190; 222/321; 239/343

[58] Field of Search ..... 222/189, 190, 321, 385; 239/327, 343

[56] References Cited

U.S. PATENT DOCUMENTS

| | | | |
|---|---|---|---|
| 4,274,594 | 6/1981 | Ito | 239/327 |
| 4,432,496 | 2/1984 | Ito | 239/327 |
| 4,615,465 | 10/1986 | Grothoff | 222/190 X |
| 4,836,422 | 6/1989 | Rosenberg | 222/190 |

FOREIGN PATENT DOCUMENTS 56-53066 9/1981 Japan .

*Primary Examiner*—Michael S. Huppert
*Attorney, Agent, or Firm*—Felfe & Lynch

[57] ABSTRACT

A container in which air and a foamable liquid are passed through porous gas/liquid mixing members at which the foamable liquid and air are mixed together to be foamed so that the foam of the foaming liquid may be discharged from the container. The gas/liquid mixing members are porous films of which one is disposed at the bottom of a cylinder and at least two are disposed in a hollow piston inclusive of a hollow piston rod at predetermined spacing. A check valve is provided at the bottom of the cylinder. A liquid passage hole in communication with a downwardly extending liquid passage pipe is provided. A gas passage hole opens to a junction of the liquid passage pipe and liquid passage hole to form a gas/liquid mixing portion, and a second check valve is provided in the piston rod.

3 Claims, 1 Drawing Sheet

CONTAINER FOR FOAMY LIQUID DISCHARGED IN SMALL AMOUNTS

BACKGROUND OF THE INVENTION

This invention relates to a container for foamy liquid such as shampoo to be discharged in small amounts.

DESCRIPTION OF THE PRIOR ART

Conventionally, containers for foamy liquid to be discharged in small amounts are well known. Particularly, this type of container as disclosed in many publications including Japanese Utility Model Application Laid-open No. 56-53066 comprises a container body, a cylinder mounted in a mouth of the container body, a hollow piston fitted, upwardly and downwardly movably, in the cylinder and having on its top a hollow piston rod, a porous gas/liquid mixing member disposed in a passage defined by the cylinder, hollow piston and hollow piston rod, and a nozzle provided on the top end of the hollow piston rod, the piston being operable to be moved upwardly and downwardly to cause a foamable liquid and air in the container body to pass through the gas/liquid mixing member at which the foamable liquid and air are mixed together to be foamed so that the foam of the foamy liquid may be discharged from the container in small amounts.

Usually, the size of the foam of the foamy liquid discharged from the container is desired to be small and to this end, the size of pores in the gas/liquid mixing member through which the liquid and air pass must be small.

However, the gas/liquid mixing member used in the prior art container is a porous block having a long gas/-liquid passage distance and if the size of pores is reduced, resistance against passage of the gas and liquid is increased and it is difficult for the contents in the container to discharge. Accordingly, in the prior art container, the size of pores in the gas/liquid mixing member is compelled to be large and disadvantageously, a foamy liquid having small-sized foam can not be obtained.

Another container is also well known wherein pressurized gas such as freon gas is fitted in a metal can and the contained liquid is mixed with the gas to be foamed, thereby producing shaving foam. This known container, however, needs to be airtight and besides large-scale equipments are required for filling the pressurized gas.

SUMMARY OF THE INVENTION

This invention contemplates elimination of drawbacks of the conventional containers and has for its object to provide a container which can produce a foaming liquid of relatively small-sized foam and which can dispense with large-scale equipments for charging liquid contents.

According to the invention, to accomplish the above object, there is provided a container wherein a plurality of gas/liquid mixing members are provided which are formed of porous films, one gas/liquid mixing film being disposed at the bottom of the cylinder and at least two gas/liquid mixing films being disposed in the piston inclusive of the piston rod at predetermined spacing, a check valve is provided in a liquid passage hole formed at the bottom of the cylinder, a downwardly extending liquid passage pipe in communication with the liquid passage hole is provided, a gas passage hole opens to a junction of the liquid passage pipe and liquid passage hole to form a gas/liquid mixing portion, and a second check valve is provided in the piston rod.

When the piston is moved downwards, a mixture of liquid and gas in the cylinder sequentially passes through the gas/liquid mixing films disposed in the piston and opens the check valve provided in the piston rod to discharge foam of a foaming liquid to the outside of the container while the check valve provided in the liquid passage hole formed at the bottom of the cylinder is blocked. Subsequently, when the piston is moved upwards, the check valve provided in the passage in the piston rod is blocked and the liquid passage hole is opened so that the liquid and air in the container enter the cylinder through the liquid passage pipe and gas passage hole and are pre-mixed at the gas/liquid mixing portion to produce a foamy liquid which in turn is drawn into the cylinder chamber.

Since, in accordance with the invention, the gas/liquid mixing members are porous films and one gas/liquid mixing film is disposed at the bottom of the cylinder with at least two gas/liquid mixing films disposed in the piston inclusive of the piston rod at predetermined spacing, the distance across each gas/liquid mixing film through which the gas and liquid pass can be short to decrease resistance against the gas and liquid and the size of pores in the gas/liquid mixing films can be relatively small. Consequently, the foam of foamy liquid can be reduced in size to take the form of creamy and uniform foam which is comparable to that produced by the pressurized gas type container. In addition, the container of this invention can dispense with the conventional large-scale equipments for charging foamy liquid in the container and it can be simplified in construction and manufactured at low costs.

DESCRIPTION OF THE PREFERRED EMBODIMENTS

Figure 1:
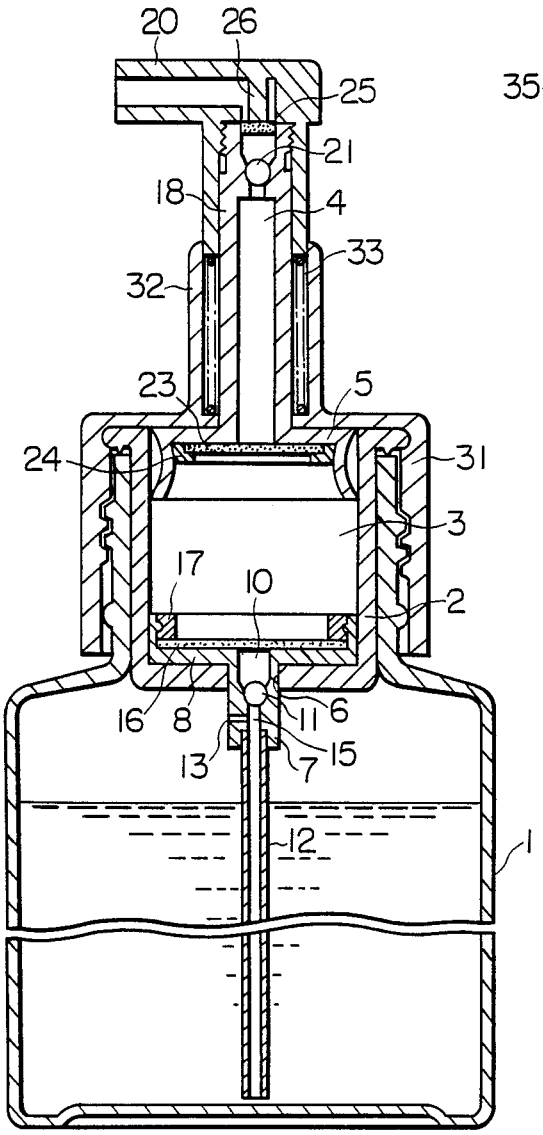
FIG. 1 is a longitudinally sectional front view illustrating an embodiment of a container according to the invention with a piston raised.

Referring now to FIG. 1, reference numeral 1 designates a container body having it mouth mounted with a cylinder 2, and a hollow piston 5 is fitted, upwardly and downwardly movably, in a chamber 3 of the cylinder 2. Formed in the bottom of the cylinder 2 is an opening 6 in which a holder 8, adapted to hold a gas/liquid mixing film 16 to be described later and having a downward projection 7, is fitted so that the downward projection 7 blocks the opening 6 and protrudes into the container body 1. Formed in the downward projection 7 of the holder 8 is a liquid passage hole 10 in which a check valve 11 comprised of a ball valve is provided. The lower end of the liquid passage hole 10 merges into a liquid passage pipe 12 which extends from the lower portion of the downward projection 7 and almost reaches the bottom of the container body 1. A lateral gas passage hole 13 is formed in the wall of the downward projection 7 near a junction of the liquid passage pipe 12 and liquid passage hole 10, thus forming a gas/-liquid mixing portion 15 near the junction.

A gas/liquid mixing film 16 made of a porous resin material such as nylon No. 66 and having porosity measuring a mesh size of 109 to 380 is held on the holder 8 with its outer peripheral upper surface pushed down by a press ring 17.

The piston 5 has an upwardly extending hollow piston rod 18 having a top end connected with a nozzle 20. Provided in a passage 4 of the hollow piston rod 18 is a check valve 21 comprised of a ball valve. A gas/liquid mixing film 23 similar to the gas/liquid mixing film 16 abuts against the back of the top of piston 5 forming the base of the piston rod 18 with its outer peripheral lower surface pushed up by a press ring 24. A gas/liquid mixing film 25, like the gas/liquid mixing films 16 and 23, is held by a projection 26 of the nozzle 20 in the passage 4 and above the check valve 21. The nozzle 20 is received in a cylinder 32 extending upwards from a cap 31 for the container body 1 and is normally urged upwards by a spring 33 inserted between the bottom of nozzle 20 and the top surface of cap 31.

The operation of this embodiment will now be described.

Referring to FIG. 1 showing the state before start of use, when the piston 5 is pushed down in opposition to the spring 33, the check valve 11 blocks the liquid passage hole 10 and the check valve 21 opens the passage 4, with the result that air in the cylinder chamber 3 passes through the gas/liquid mixing films 23 and 25 and a liquid discharge passage in the nozzle 20 connected to the piston rod 18 and is discharged to the outside.

Subsequently, the push-down force on the piston 5 is removed and restoring force of the spring 33 causes the piston 5 to recover the original position. At that time, the check valve 21 blocks the passage 4 and the check valve 11 opens the liquid passage hole 10, with the result that liquid and air in the container body 1 entering the liquid passage pipe 12 and gas passage hole 13, respectively, are pre-mixed at the gas/liquid mixing portion 15, passed through the liquid passage hole 10 and gas/liquid mixing film 16 at which they are further mixed together, and drawn into the cylinder chamber 3.

The mixture of liquid and gas thus drawn into the piston chamber 3 is ready to be discharged as a foaming liquid.

Under this condition of container, in order to discharge the foamy liquid, the piston 5 is again pushed down in the manner described previously to place each of the cooperative members in the same condition as described previously. But in this phase, in addition to air, the drawn mixture in the form of foamy liquid is sequentially passed, under the influence of compression of the cylinder chamber 3 by the piston 5, through the gas/liquid mixing films 23 and 25 at which the mixing of the foamy liquid with air is promoted to uniform the foam, and as a result small-sized creamy foam is discharged through the nozzle 20 to the outside.

Subsequently, the above operation is repeated until the desired amount of foaming liquid is discharged.

Figure 2:
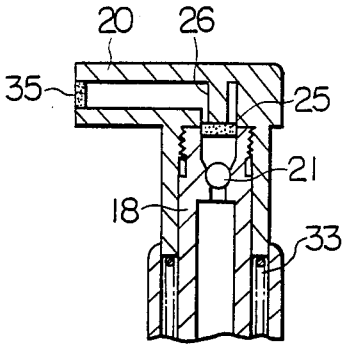
FIG. 2 is a fragmentary sectional view illustrating another embodiment of the nozzle.

FIG. 2 shows another embodiment of this invention. This embodiment differs from the foregoing embodiment only in that a gas/liquid mixing film 35, like the gas/liquid mixing films 16, 23 and 25, is additionally provided in the tip end opening of the nozzle 20. Thus, the number of the gas/liquid mixing films used is increased to 4 in this embodiment, thereby further promoting the size reduction of the foam of the foamy liquid to be discharged.

The location of the gas/liquid mixing films 23, 25 and 35 in the foregoing embodiments is described for illustrative purpose only and they may be disposed at desired locations in the piston. Further, the number of the gas/liquid mixing films is not limited to 2 to 4 but may be changed to 4 or more, thus permitting detailed design alternations and modifications within the framework of the invention.

What is claimed is:

1. A container for foamy liquid discharged in small amounts comprising a container body, a cylinder mounted in a mouth of said container body, a hollow piston fitted, upwardly and downwardly movably, in said cylinder and having on its top a hollow piston rod, porous gas/liquid mixing members disposed in a passage defined by said cylinder, hollow piston and hollow piston rod, and a nozzle provided on the top end of said hollow piston rod, said piston being operable to be moved upwardly and downwardly to cause a foamable liquid and air in said container body to pass through said gas/liquid mixing members at which the foamable liquid and air are mixed together to be foamed so that the foam of the foaming liquid may be discharged from said container in small amounts, wherein said porous gas/-liquid mixing members are provided which are formed of porous films, one gas/liquid mixing film being disposed at the bottom of said cylinder with at least two gas/liquid mixing films disposed in said piston inclusive of said piston rod at predetermined spacing, a check valve is provided in a liquid passage hole formed at the bottom of said cylinder, a downwardly extending liquid passage pipe in communication with said liquid passage hole is provided, a gas passage hole opens to a junction of said liquid passage pipe and liquid passage hole to form a gas/liquid mixing portion, and a second check valve is provided in said piston rod.

2. The container according to claim 1, wherein one of said gas/liquid mixing films is also provided in said nozzle.

3. The container according to claim 1 or 2, wherein said piston is normally urged upwards by a spring.

* * * * *